US008967788B2

(12) United States Patent
Oki

(10) Patent No.: US 8,967,788 B2
(45) Date of Patent: Mar. 3, 2015

(54) LIQUID EJECTING APPARATUS

(71) Applicant: Seiko Epson Corporation, Tokyo (JP)

(72) Inventor: Naoki Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/040,031

(22) Filed: Sep. 27, 2013

(65) Prior Publication Data

US 2014/0092185 A1 Apr. 3, 2014

(30) Foreign Application Priority Data

Oct. 1, 2012 (JP) ..... 2012-219443

(51) Int. Cl.
*B41J 2/01* (2006.01)
*B41J 11/00* (2006.01)

(52) U.S. Cl.
CPC ..... *B41J 11/002* (2013.01)
USPC ..... 347/102; 347/101

(58) Field of Classification Search
CPC ..... B41J 11/002; B41J 11/0015; B41J 2/01; B41M 7/0072; C09D 11/101
USPC ..... 347/102, 101
See application file for complete search history.

(56) References Cited

U.S. PATENT DOCUMENTS

| | | | | |
|---|---|---|---|---|
| 6,288,370 | B1 * | 9/2001 | Ogawa et al. | 219/469 |
| 2004/0190956 | A1 * | 9/2004 | Senda | 399/328 |
| 2004/0265001 | A1 * | 12/2004 | Tsusaka | 399/124 |
| 2005/0236097 | A1 | 10/2005 | Matsuhashi et al. | |
| 2008/0038031 | A1 * | 2/2008 | Koshida | 399/406 |
| 2009/0244235 | A1 * | 10/2009 | Houjou | 347/102 |
| 2011/0236102 | A1 * | 9/2011 | Furushige et al. | 399/406 |

FOREIGN PATENT DOCUMENTS

| | | |
|---|---|---|
| JP | 2001-212952 | 8/2001 |
| JP | 2005-230806 | 9/2005 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A drying unit that dries a printed paper sheet is disposed at a position downstream to a liquid ejecting head in a transportation direction. The drying unit includes a heater having a heating surface that also serves as a transportation surface of the paper sheet, an upstream roller that is disposed at a position opposite the heating surface, and a downstream roller that is disposed at a position downstream to the upstream roller in the transportation direction and opposite the heating surface. A distance between the upstream roller and the heating surface is longer than a distance between the downstream roller and the heating surface.

7 Claims, 7 Drawing Sheets

LIQUID EJECTING APPARATUS

BACKGROUND

1. Technical Field

The present invention relates to a liquid ejecting apparatus including a liquid ejecting head that ejects liquid to a medium.

2. Related Art

An ink jet printer is known as a type of liquid ejecting apparatus, for example, as described in JP-A-2001-212952 and JP-A-2005-230806. Such an ink jet printer performs printing (recording) by ejecting ink which is an example of liquid from a liquid ejecting head onto a medium such as a paper sheet.

When printing is performed by the liquid ejecting head, a printing surface of the paper sheet is wet with ink. If the paper sheet is output in the wet state, the printing surface may be smeared or smudged when a user touches the printing surface. Accordingly, a liquid ejecting apparatus which includes a heater that dries ink printed on the paper sheet before outputting the paper sheet is known.

For example, JP-A-2001-212952 discloses a liquid ejecting apparatus which includes a non-contact heater composed of a pair of plate-shaped heaters that opposes each other with a feeding path of the recording medium therebetween so as to heat the printed portion of the recording medium. The liquid ejecting apparatus further includes pairs of curl prevention mechanisms which are disposed adjacent to the non-contact heater on the upstream side and the downstream side in the feeding direction of the recording medium so as to prevent the recording medium being curled by heating. The non-contact heater is configured to dry ink on the paper sheet by heating both surfaces of the paper sheet in a non-contact manner by the pair of heaters.

JP-A-2005-230806 discloses a liquid ejecting apparatus which includes an ink jet recording unit that forms an image on a recording medium in a long strip shape such as a roll paper, a first pair of heat and pressure application rollers that heat and pressurize a transfer layer of a transfer sheet which is fed on the recording medium so as to transfer the transfer layer on the surface of the recording medium, and a second pair of heat and pressure application rollers that heat and pressurize the recording medium after the transfer layer is transferred on the surface of the recording medium. The first pair of heat and pressure application rollers is provided for thermally transferring the transfer layer of the transfer sheet on the surface of the recording medium, and the second pair of heat and pressure application rollers is provided for fusing the adhesive of the transfer layer to remove air bubbles and the like. The lower roller of the respective heat and pressure application rollers is configured to be movable up and down by an elevating unit so as to adjust the amount of pressure.

The non-contact heater described in JP-A-2001-212952, which is configured to be non-contact with the medium and to dry ink mainly by radiation heat, has a problem in that a dry efficiency is lower than that of a contact heater. Further, in the ink jet recording apparatus described in JP-A-2005-230806, although the roller for thermal transfer can also dry ink on the recording medium, the roller is in substantially linear contact with the recording medium. This configuration is preferable to move the pressurizing position of the recording medium in the transportation direction to enhance adhesion, but has a problem in that the heat transfer surface area (contact surface area) between the roller and the recording medium is small and a dry efficiency of ink is low.

Moreover, for example, if a contact heater composed of a plate-shaped heater is used to dry ink by direct contact with the paper sheet, the paper sheet such as a roll paper may not sufficiently come into contact with the surface of the heater and is lifted from the surface due to a curl of the printed paper sheet. This leads to a decrease in heat transfer efficiency from the heater to the paper sheet and a dry efficiency of ink on the paper sheet. Further, even if the paper sheet is a cut paper, since the paper sheet tends to curl with the printing surface which is wet with ink curved inward, the curled cut paper does not sufficiently come into contact with the plate-shaped heater. This also leads to a decrease in a dry efficiency of ink on the paper sheet. Therefore, there is a need for drying ink on the paper sheet more efficiently even if the paper sheet is curled or otherwise curved.

SUMMARY

An advantage of some aspects of the invention is that a liquid ejecting apparatus that allows liquid on a medium to be efficiently dried even if the medium is curled or otherwise curved is provided.

According to an aspect of the invention, a liquid ejecting apparatus including a liquid ejecting head that ejects liquid onto a medium includes a heater having a heating surface which also serves as a transportation surface of the medium, the heater being disposed downstream to the liquid ejecting head in a transportation direction of the medium; a rotatable upstream roller that is disposed at a position opposite the heating surface with respect to a transportation path of the medium; and a rotatable downstream roller that is disposed at a position downstream to the upstream roller in the transportation direction and opposite the heating surface with respect to the transportation path of the medium, wherein a distance between the upstream roller and the heating surface and a distance between the downstream roller and the heating surface are different.

With this configuration, even if the medium is curled, one of the upstream roller and the downstream roller which has a larger distance from the heating surface can hold the medium so that the medium is not lifted the heating surface and press the medium toward the heating surface, and then the other of the upstream roller and the downstream roller which has a smaller distance from the heating surface can press the medium further close to the heating surface. Accordingly, even if the medium is curled, liquid on the medium can be efficiently dried on the heating surface (transportation surface) of the heater.

In the liquid ejecting apparatus according to the above aspect of the invention, the distance between the upstream roller and the heating surface is preferably larger than a distance between the downstream roller and the heating surface.

With this configuration, the curled leading edge of the medium can be guided into the gap between the upstream roller and the heating surface with certainty. Further, since the upstream roller prevents the medium from being lifted from the heating surface, and then the downstream roller presses the medium toward the heating surface, the medium can be transported close to the heating surface. Accordingly, for example, the surface area of the medium which abuts against the heating surface can be increased.

In the liquid ejecting apparatus according to the above aspect of the invention, the upstream roller is preferably a driven roller which is rotated when the transported medium abuts against the upstream roller, and the downstream roller is preferably a driving roller that transports the medium while pressing the medium.

With this configuration, even if the upstream roller is a driven roller which is rotated while pressing the medium, the distance from the heating surface is relatively large and the medium is not strongly pressed against the heating surface by the upstream roller. Accordingly, the transportation resistance applied to the medium can be decreased, thereby preventing a decrease in the positional accuracy in transportation of the medium caused by the transportation resistance of the medium.

In the liquid ejecting apparatus according to the above aspect of the invention, the upstream roller and the downstream roller preferably include a shaft and a roller member that is rotatable integrally with the shaft or relatively to the shaft, and the roller member of the upstream roller and the roller member of the downstream roller are preferably made of different materials.

With this configuration, since the roller member of the upstream roller and the roller member of the downstream roller are made of different material, different friction resistances can be applied between each of the roller members and the medium. For example, if the friction resistances between each of the roller members and the medium are both large, the transportation resistance caused by the friction resistances is applied to the medium, thereby leading to a decrease in the positional accuracy in transportation of the medium. As a result, for example, there is a risk that the positional accuracy of ink ejected onto the medium may be decreased. However, since the friction resistances between each of the roller members and the medium are different, the transportation resistance applied to the medium from the roller member which has the smaller friction resistance to the medium can be decreased relatively small. Further, if the rollers are composed of driving rollers, an appropriate friction resistance depending on the material of the roller member of the roller is applied to the medium, thereby transmitting the rotation force of the roller member to the medium with certainty.

In the liquid ejecting apparatus according to the above aspect of the invention, the roller member of the upstream roller is preferably made of a material harder than that of the roller member of the downstream roller, and a plurality of the roller members of the upstream roller are preferably provided spaced apart from each other in an axial direction.

With this configuration, the roller member of the upstream roller is made of a material harder than that of the roller member of the downstream roller, and a plurality of the roller members are provided spaced apart from each other in an axial direction of shaft. Accordingly, the contact surface area on the liquid applying surface of the medium which is not yet dried can be decreased relatively small, and the transportation resistance applied to the medium can be decreased, thereby preventing the liquid on the medium which is not yet dried from being transferred to the roller member.

In the liquid ejecting apparatus according to the above aspect of the invention, the roller member of the downstream roller is preferably made of sponge.

With this configuration, even if the roller member of the downstream roller pressed the medium against the heating surface of the heater, the roller member tends to deform due to the cushioning property. Accordingly, the transportation resistance applied to the medium can be decreased relatively small. Further, if the downstream roller is a driving roller, an appropriate friction resistance between the roller member made of sponge and the medium is applied to the medium, thereby transmitting the rotation force of the roller member to the medium with certainty and transporting the medium with certainty.

In the liquid ejecting apparatus according to the above aspect of the invention, the roller member of the downstream roller preferably has a length in an axial direction that covers the entire area in a width direction of the medium.

With this configuration, the roller member of the downstream roller can press the entire area in the width direction of the medium. Accordingly, a large abutting surface area (contact surface area) between the medium and the heating surface can be obtained, thereby facilitating drying of the medium.

In the liquid ejecting apparatus according to the above aspect of the invention, a pair of transportation rollers that transports the medium is preferably disposed between the liquid ejecting head and the upstream roller in the transportation direction.

With this configuration, the transportation resistance applied to the medium when the medium is pressed by the upstream roller and the downstream roller is decreased relatively small, thereby preventing a decrease in positional accuracy in transportation of the medium transported by the pairs of transportation rollers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
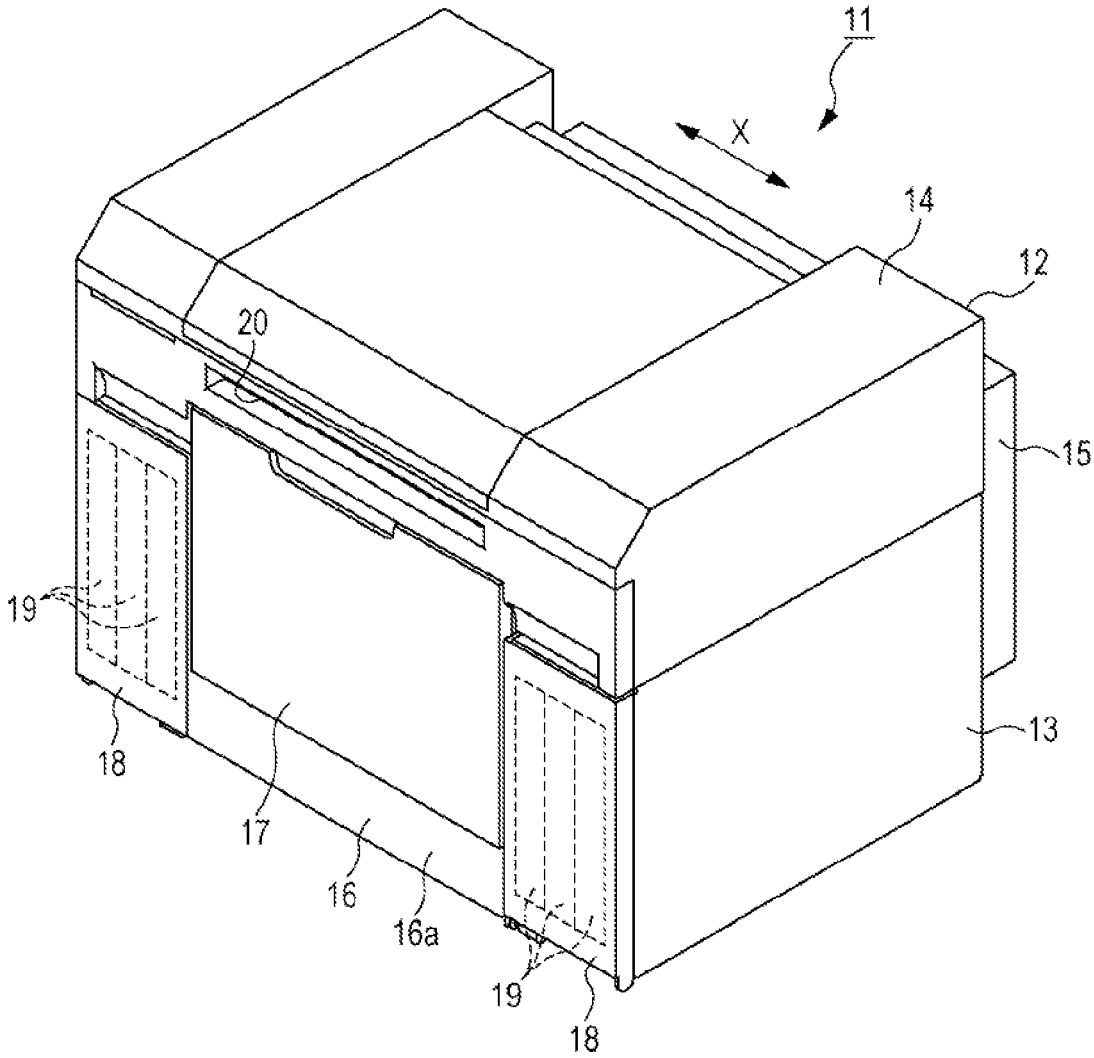
FIG. 1 is a perspective view of a recording apparatus according to an embodiment of the invention.

An ink jet recording apparatus which is an example of liquid ejecting apparatus will be described below with reference to the drawings. As shown in FIG. 1, a recording apparatus 11 according to this embodiment includes a housing 12 formed in a substantially rectangular box shape. The housing 12 includes a first container 13, a second container 14 disposed on the upper side of the first container 13 and a third container 15 disposed on the back side of the first container 13.

A drawer-type holding frame 16 has a front end face 16*a* which is disposed on the front side of the first container 13. Further, on the front side of the first container 13, a front face cover 17 is detachably mounted at an upper position of the front end face 16*a* and openable covers 18 are rotatably provided on each end of the holding frame 16 in a width direction X.

Each openable cover 18 pivotally rotates about a rotation shaft provided in a lower end portion, which is not shown in the figure, so as to be movable between a closed position which is shown in FIG. 1 and an open position. When the openable cover 18 rotates forward from the closed position, an upper end of the openable cover 18 moves to the open position and the inside is exposed. In the open position, a cartridge holder (not shown in the figure) in which ink cartridges 19 that store ink which is an example of liquid are detachably mounted is exposed. Further, an output port 20 is disposed on the front face of the second container 14 so that the printed paper sheet is output therethrough.

Figure 2:
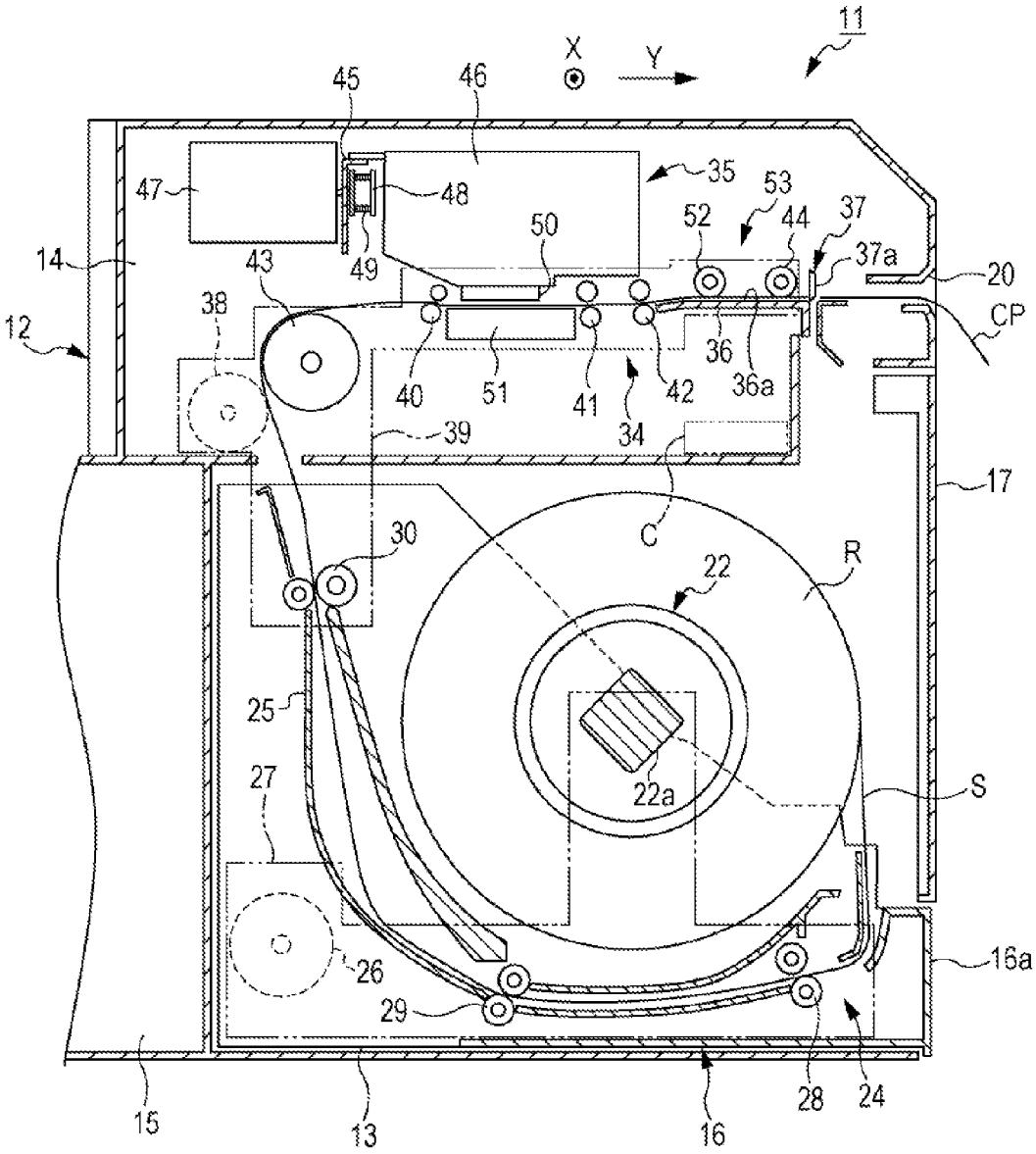
FIG. 2 is a schematic side sectional view of the recording apparatus.

As shown in FIG. 2, when the front face cover 17 is removed from the housing 12, the holding frame 16 is exposed. A holder 22 is provided on the holding frame 16 so as to rotatably support a roll R which is formed of a rolled long strip of paper sheet S, which is an example of medium, via a support shaft 22*a*. Further, a plurality of rolls R having different sizes can be set on the holder 22. When the roll R is set on the holder 22, the roll R is aligned to one end (on the right side in FIG. 1) of the holder 22 in the width direction X.

As shown in FIG. 2, a feed mechanism 24 that feeds the paper sheet S to the second container 14 is provided on the holding frame 16. The feed mechanism 24 includes a feed path forming member 25 which is disposed along the feed path of the paper sheet S, a feed motor 26 which is a drive source, a drive force transmission mechanism 27 that transmits a drive force from the feed motor 26 and pairs of transportation rollers 28, 29, 30 that nip and transport the paper sheet S.

The pairs of the transportation rollers 28, 29, 30 are each composed of a driving roller that is rotated by a drive force from the drive source and a driven roller which corresponds to the driving roller. Further, the driving roller of the pairs of transportation rollers 28, 29 and the holder 22 are rotated by a drive force of the feed motor 26.

The second container 14 includes a transportation mechanism 34 that transports the paper sheet S to the output port 20, a recording unit 35 that performs recording by ejecting ink onto the paper sheet S which is transported by the transportation mechanism 34, a heater 36 that dries the paper sheet S on which ink is applied and a cutter unit 37 having a cutter 37*a* for cutting the paper sheet S.

The transportation mechanism 34 includes a transportation motor 38 which is a drive source, a drive force transmission mechanism 39 that transmits a drive force from the transportation motor 38, pairs of transportation rollers 40 to 42 that nip and transport the paper sheet S and driving rollers 43, 44 that are rotated by a drive force of the transportation motor 38. The driving roller of the pair of transportation rollers 30 is connected to the drive force transmission mechanism 39 in a state capable of transmitting the drive force and is rotated by the drive force of the transportation motor 38.

The recording unit 35 includes a guide rail 45 that extends in a main scan direction X (a direction perpendicular to the plane of FIG. 2), a carriage 46 that is held on the guide rail 45 so as to be reciprocatable in the main scan direction X, a carriage motor 47 which is a drive source to move the carriage 46 along the guide rail 45. Further, the recording unit 35 includes a pair of pulleys 48 (only one of the pair is shown in FIG. 2) which are spaced from each other by a predetermined distance in the main scan direction X and an endless timing belt 49 wound around the pair of pulleys 48. One of the pulleys 48 is connected to an output shaft of the carriage motor 47. Accordingly, when the carriage motor 47 drives forward and backward, the carriage 46 which is connected to a portion of the timing belt 49 reciprocates along the guide rail 45.

A liquid ejecting head 50 that is capable of ejecting ink is provided on the underside of the carriage 46. Further, a support member 51 that supports the paper sheet S is provided under the carriage 46 so as to extend in the main scan direction X between the pair of transportation rollers 40 and the pair of transportation rollers 41 which are positioned along the transportation path.

After recording (printing) is performed on the paper sheet S in the recording unit 35, the paper sheet S is transported on the heater 36 by the pairs of transportation rollers 41, 42 which are arranged in a transportation direction Y between the liquid ejecting head 50 and the heater 36. The heater 36 is formed in a plate shape that extends in the transportation direction Y of the paper sheet S and the top surface of the heater 36 is provided as a heating surface 36*a*. The heating surface 36*a* also serves as a transportation surface that guides the paper sheet S while supporting the opposite surface (back surface) of a printing surface of the paper sheet S. The paper sheet S is dried when being transported along the heating surface 36*a* of the heater 36. Further, an upstream roller 52 is provided to hold the paper sheet S at a position above the heater 36 on the upstream side in the transportation direction Y and the driving roller 44 is provided as an example of downstream roller which is positioned apart from the upstream roller 52 on the downstream side (on the right side in FIG. 2) in the transportation direction Y by a predetermined distance. In the following description, the driving roller 44 that holds the paper sheet S at a position downstream to the upstream roller 52 in transportation direction Y may be referred to as the downstream roller 44. In this embodiment, a drying unit 53 that dries ink on the paper sheet S is formed by the heater 36, the upstream roller 52 and the downstream roller 44 and the like.

After the paper sheet S passes on the heater 36 and is dried, the paper sheet S is cut, for example, into cut papers CP of unit length by the cutter 37*a* of the cutter unit 37. After recording is performed on the cut paper CP, the cut paper CP is output to the outside of the housing 12 through the output port 20. A controller C that controls the recording apparatus 11 is disposed in the second container 14. The motors 26, 38, 47, the liquid ejecting head 50, the heater 36 and the cutter unit 37 are controlled by the controller C.

The paper sheet S is transported downstream in the transportation direction Y by the pair of transportation rollers 42, and then transported on the heating surface 36*a* of the plate-shaped heater 36 which serves as the transportation surface. During transportation of the paper sheet S, the paper sheet S is pressed toward the heater 36 by the upstream roller 52 while being pressed toward the heating surface 36*a* of the heater 36 by the downstream roller 44. Accordingly, the ink applied on the paper sheet S is dried by heat imparted to the paper sheet S from the heating surface 36*a* of the heater 36.

After the paper sheet S is dried by the heater 36, the paper sheet S passes a moving path of the cutter 37*a* of the cutter unit 37 which is disposed downstream to the heater 36 in the transportation direction Y. When the cutter 37*a* moves to traverse the paper sheet S in the main scan direction X (paper width direction) while the paper sheet S is stationary, the paper sheet S is cut at print break positions in the transportation direction Y. After the paper sheet S is cut into the cut papers CP, the cut papers CP are transported downstream in the transportation direction Y and are output through the output port 20 to the outside of the apparatus.

Figure 3:
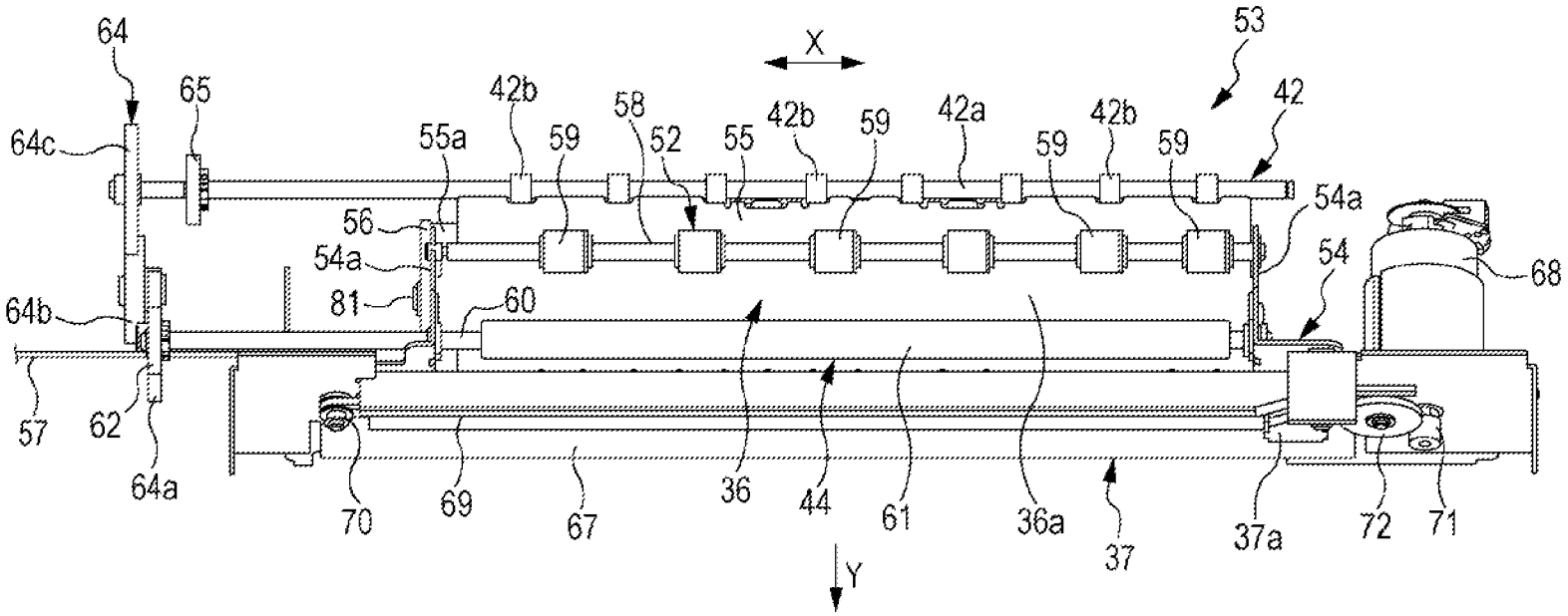
FIG. 3 is a perspective view as seen from the front side of a drying unit and a cutter unit.
Figure 4:
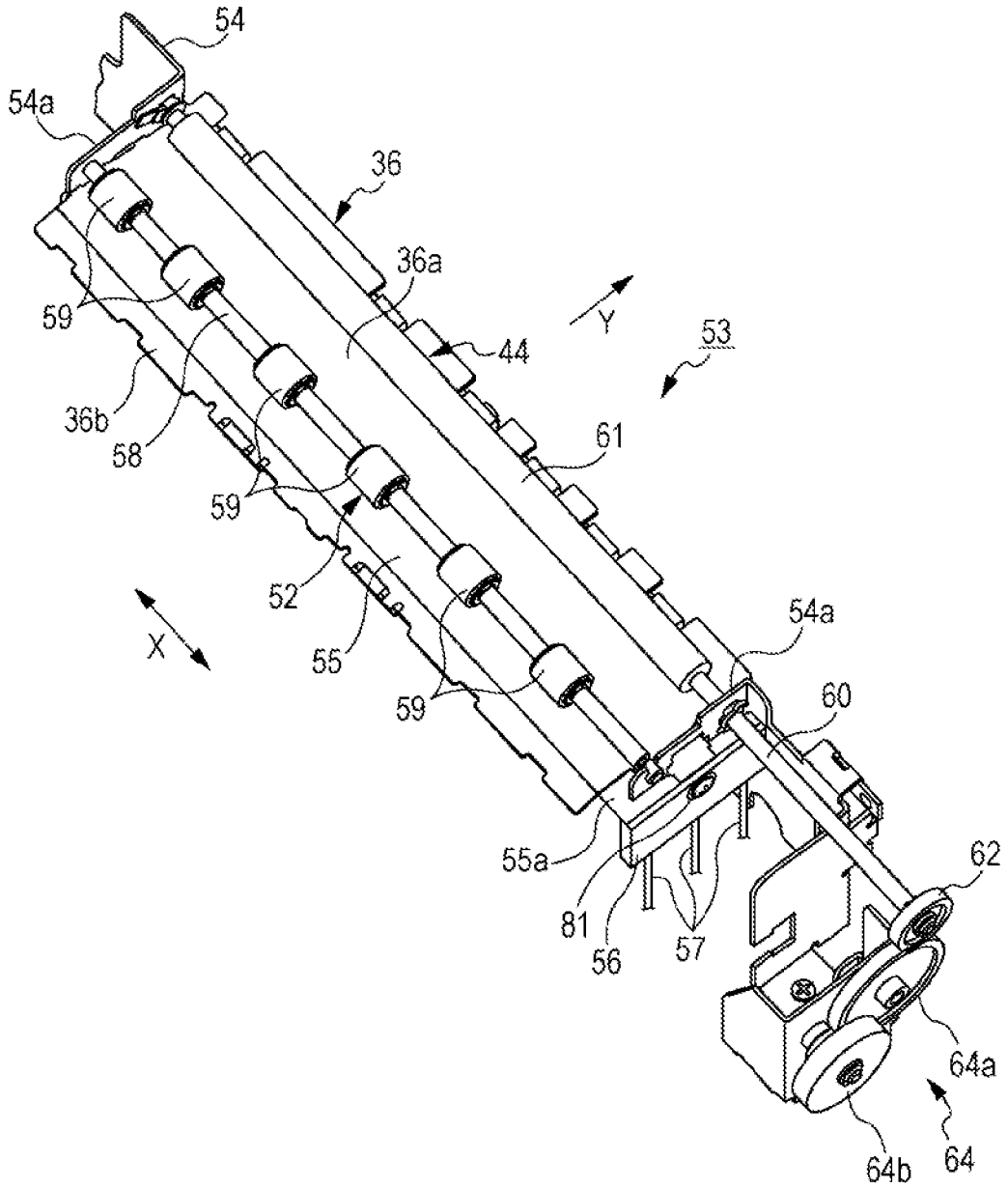
FIG. 4 is a perspective view of the drying unit.

Next, with reference to FIGS. 3 to 5, the drying unit 53 will be described in detail. As shown in FIGS. 3 and 4, the heater 36 includes a heater unit 55 formed as an elongated substantially rectangular plate that extends in the scan direction X and a terminal plate 56 formed as a rectangular plate that bends at one end of the heater unit 55 in the longitudinal direction (on the left end in FIG. 3) and extends downward. A front frame 54 which is shown in FIGS. 3 and 4 is provided so as to extend in the width direction X at a position downstream in the transportation direction Y in the housing 12 of the recording apparatus 11. The front frame 54 extends in the transportation direction Y and has a pair of side plates 54*a* that opposes each other in the width direction X. The heater 36 is disposed with both ends of the heater unit 55 in the longitudinal direction being fixedly attached to the pair of side plates 54*a* such that the heating surface 36*a* is located at a predetermined height in a substantially horizontal position as a transportation surface of the paper sheet S.

The heating surface 36*a* of the heater unit 55 provides a flat surface which is parallel to the transportation direction Y of the paper sheet S. The heater unit 55 has a length (width) in the main scan direction X sufficient to heat the entire area in the width direction of the paper sheet S having the maximum width available for printing in the recording apparatus 11, and a predetermined length in the transportation direction Y which allows for the necessary dry time based on the transportation speed of the paper sheet S. A plurality of (in this example, three) wires 57 extend from the terminal plate 56 so as to supply electric power (electric current) to a heating element 55*a* in the heater unit 55. The plurality of wires 57 are connected to an electric power generator, which is not shown in the figure, so that electric current is supplied from the electric power generator via the wires 57 to the heating element 55*a* and the like which heat the heating surface 36*a* to a set temperature.

As shown in FIG. 3, the pair of transportation rollers 42 is disposed at a position almost adjacent to the upstream end of the heater 36 in the transportation direction Y. The transportation rollers 42 are rotatably supported by a rotation shaft 42*a* that extends parallel to the width direction X. A plurality of small roller members 42*b* each having a short axial length are provided on the rotation shaft 42*a* and are equally spaced from each other in the axial direction. The printed paper sheet S is nipped by the pair of transportation rollers 42 and is transported on the heating surface 36*a* of the heater 36. In this example, the plurality of roller members mounted on the rotation shaft of the driven rollers of the respective pairs of transportation rollers 41, 42 (for example, the upper rollers in FIG. 2) at intermittent positions in the axial direction are rubber rollers instead of toothed rollers (so-called knurled rollers). The rubber roller has a small roller width (for example, the roller width is in a range of 1 to 2 mm) in order to decrease a contact surface area of the roller with the paper sheet S and prevent ink transfer to the rollers as much as possible.

As shown in FIGS. 3 and 4, the upstream roller 52 is disposed so as to oppose the heating surface 36*a* of the heater 36 with respect to the transportation path of the paper sheet S at a position on the upstream side of the heating surface 36*a* in the transportation direction Y. The upstream roller 52 in this example is a driven roller and is rotated by a force exerted from the transported paper sheet S. The upstream roller 52 includes a support shaft 58 which is an example of shaft both ends of which are secured to the right and left side plates 54*a* and a plurality of roller members 59 which are supported on the support shaft 58 in a relatively rotatable manner and are spaced from each other by a predetermined distance in the axial direction. The plurality of roller members 59 are made of a relatively hard material, which is a resin in this example. The material of the roller members 59 includes, for example, POM (polyacetal resin). The roller members 59 made of POM have a relatively high hardness which reduces ink applied on the roller members 59. Since the roller members 59 which come into contact with the printing surface of the paper sheet S are intermittently arranged in the axial direction (that is, in the main scan direction X), the contact surface area of the upstream roller 52 with the paper sheet S becomes relatively small. Further, the roller members 59 have water repellency in addition to a relatively high hardness. Accordingly, even if the roller members 59 come into contact with the surface of the paper sheet S which is not yet dried when pressing the paper sheet S, ink transfer from the paper sheet S can be reduced and a problem such as smudging and rubbing on the printing surface can be prevented. Further, since the plurality of roller members 59 are rotatably supported on the support shaft 58, the roller members 59 can be rotated only by coming into contact with a portion of the paper sheet S, thereby reducing transportation resistance.

As shown in FIGS. 3 and 4, the downstream roller 44 is disposed so as to oppose the heating surface 36*a* with respect to the transportation path of the paper sheet S at a position downstream to the upstream roller 52 in the transportation direction Y. The downstream roller 44 is a driven roller that is rotatable by the drive force of the transportation motor 38 (see FIG. 2). The downstream roller 44 includes a rotation shaft 60 which is an example of shaft both ends of which are secured to the right and left side plates 54*a* and a roller member 61 formed in a cylindrical shape elongated in the axial direction and mounted on the rotation shaft 60 so as to be rotatable with the rotation shaft 60. In this example, the roller member 61 and the roller member 59 are made of different material. The roller member 61 is made of a material softer than that of the roller member 59, for example, sponge. That is, the roller member 61 in this example is a sponge roller made of a cylindrically shaped sponge. The roller member 61 has a length in the axial direction sufficient to press the entire area in the width direction of the paper sheet S.

A gear 62 is secured to one end of the rotation shaft 60. The gear 62 meshes with a gear 64*a* which is one of gears in the drive force transmission mechanism 39 of a transportation system shown in FIGS. 3 and 4. The gear 64*a* forms a gear train 64 together with the gears 64*b*, 64*c* and the like. Accordingly, the rotation shaft 60 is connected to the rotation shaft 42*a* on the driving side of the pair of transportation rollers 42 via the gear train 64, thereby transmitting the drive force. A gear 65 is fixedly mounted on the rotation shaft 42*a* at a position close to the end of the rotation shaft 42*a*. The rotation shaft 42*a* rotates when the drive force of the transportation motor 38 is transmitted to the gear 65. As the rotation shaft 42*a* rotates, the downstream roller 44 rotates via the gear train 64 and the gear 62.

The roller member 61 of the downstream roller 44 is provided as a single roller elongated in the axial direction and is made of a soft material for the purposes of efficiently transmitting the transportation force to the paper sheet S and ensuring a contact surface area between the paper sheet S and the heating surface 36*a* as large as possible when the paper sheet S is pressed against the heating surface 36*a*. In this example, since the roller member 61 is formed by a sponge roller as described above, it is possible to achieve an appropriate amount of friction resistance which is necessary to transmit the transportation force between the paper sheet S and the roller member 61 when the paper sheet S is pressed against the roller member 61 while preventing an excessive friction force from being generated between the paper sheet S and the heating surface 36*a*. For example, even if the roller member 61 presses the paper sheet S with a strong pressing force due to the distance between the downstream roller 44 and the heating surface 36*a* varying to a smaller value than the set value, the roller member 61 formed by a sponge roller having a cushioning property deforms in a direction in which the amount of pressing force is mitigated, thereby often preventing an excessive transportation resistance from being applied to the paper sheet S.

As shown in FIG. 3, the cutter unit 37 is fixedly mounted on the front frame 54 at a position adjacent to the downstream end of the drying unit 53 in the transportation direction Y. The cutter unit 37 includes a frame 67 formed as a substantially rectangular plate that extends in the width direction X, an electric motor 68 that is fixedly mounted on one end of the frame 67, a timing belt 69 that is wound to extend in the width direction X so as to be rotatable by the drive force of the electric motor 68 and the cutter 37*a* which is connected to a portion of the timing belt 69. The timing belt 69 is wound around a pair of pulleys 70 (only one of the pair is shown in FIG. 3) which are spaced from each other by a predetermined distance in the width direction X of the frame 67. The timing belt 69 is rotated forward and backward when one of the pulleys 70 (on the driving side) is rotated by the drive force of the electric motor 68 via the gear 72 which meshes with the gear 71 connected to an output shaft of the electric motor 68. As the timing belt 69 rotates forward and backward, the cutter 37*a* reciprocates in the width direction X moves from a stand-by position which is shown in FIG. 3 to. The cutter 37*a* cuts the paper sheet S during forward movement and moves back to a stand-by position during backward movement.

Next, with reference to FIGS. 4 and 5, a configuration of the heater 36 will be described below. As shown in FIGS. 4 and 5, the heater 36 includes the heater unit 55 formed as a rectangular plate that is elongated in the width direction X and having the heating surface 36*a* which also serves as the transportation surface of the paper sheet S. As shown in FIG. 5, the heater unit 55 includes a support plate 75 formed as a metal plate in a rectangular shape, a heating plate 76 formed as a metal plate which is shaped and sized substantially the same as the support plate 75 and having the top surface which serves as the heating surface 36*a*, and a heating element 55*a* formed as a single thin plate that is held between the support plate 75 and the heating plate 76. In this example, the heating element 55*a* is, for example, a film heater 77. The film heater 77 is formed by etching a metal layer of a heater material which is formed on the surface of a thin substrate so as to form a predetermined wiring pattern (etching pattern) having a relatively large wiring length per unit surface area on the substrate. In this example, the film heater 77 is used to obtain a large heat capacity in a limited heating area. In FIG. 5, the wiring pattern formed on the film heater 77 is not shown.

In this example, both the support plate 75 and the heating plate 76 are made of aluminum. Since aluminum has a heat conductivity higher than iron which is a material of the frame member such as the front frame 54, it is possible that the heating surface 36*a* reaches a set temperature (target heating temperature) in a relatively short period of time after energization of the film heater 77 is started.

Figure 5:
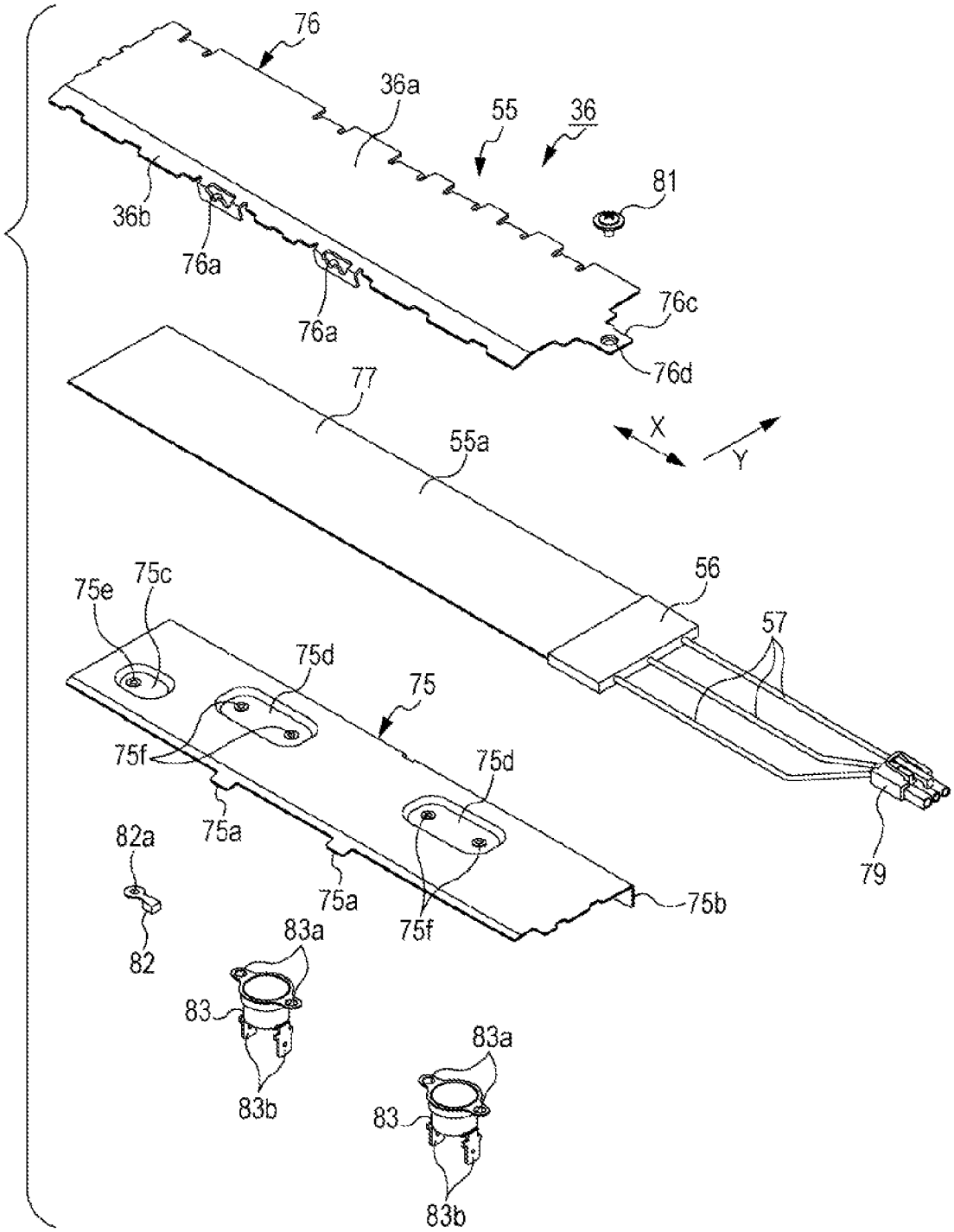
FIG. 5 is an exploded perspective view of a heater.

As shown in FIG. 5, one end of the film heater 77 in the longitudinal direction is connected to the terminal plate 56. The plurality of wires 57 extending from the terminal plate 56 are connected to a terminal member 79, and the terminal member 79 is connected to a connection terminal which is connected to an electric power generator (not shown in the figure) via wires.

The support plate 75 and the heating plate 76 are fastened to each other with the film heater 77 of FIG. 5 interposed therebetween. As shown in FIG. 5, the support plate 75 in a rectangular shape has a pair of engagement projections 75*a* formed on one of the long sides (on the upstream side in the transportation direction Y in FIG. 5) at two positions in the longitudinal direction. Similarly, the heating plate 76 also in a rectangular shape has a pair of engagement holes 76*a* at positions which correspond to the pair of engagement projections 75*a*. The support plate 75 and the heating plate 76 are fastened to each other by the pair of engagement projections 75*a* and the pair of engagement holes 76*a* on the support plate 75 and the heating plate 76 engaging with each other.

Figure 6:
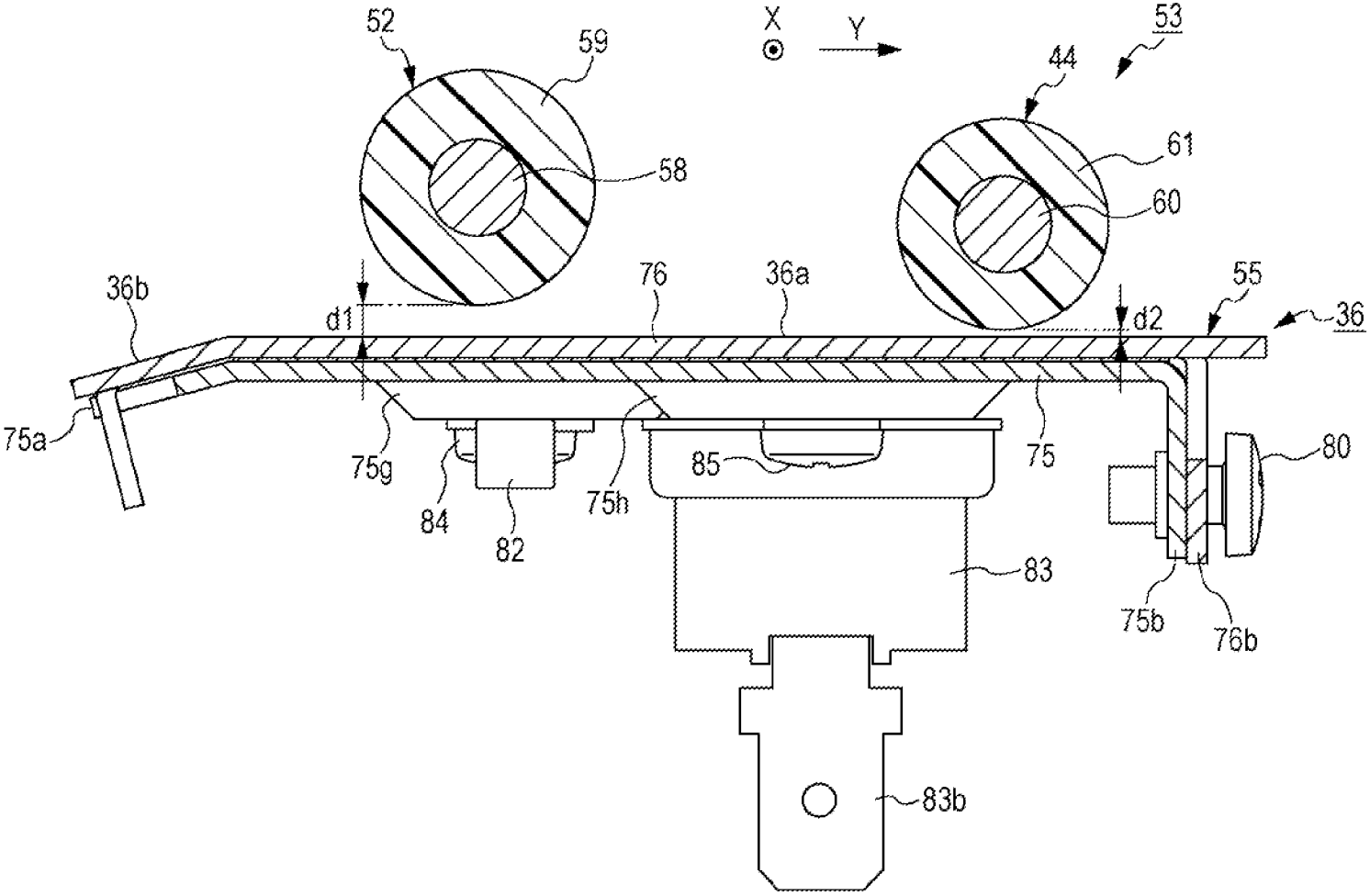
FIG. 6 is a side sectional view of the drying unit.

As shown in FIG. 6, the support plate 75 and the heating plate 76 have extending portions 75*b*, 76*b*, respectively, on end portions (on the right side in FIG. 6) which is opposite to an engagement side (on the left side in FIG. 6). The extending portions 75*b*, 76*b* bend in a direction away from the heating surface 36*a* (downward in FIG. 6). The extending portions 75*b*, 76*b* are tightened together by a screw 80 so that the end portions of the support plate 75 and the heating plate 76 are fastened together. Further, as shown in FIG. 5, a projection 76*c* having an insertion hole 76*d* into which a screw 81 is insertable is formed on one end (the right end in FIG. 5) of the heating plate 76 so as to extend in the longitudinal direction of the heating plate 76. The heating plate 76 is assembled to cover the film heater 77 with the projection 76*c* being held by the terminal plate 56. As shown in FIG. 4, an end portion of the heater 36 on the side of the terminal plate 56 is fixedly mounted on the front frame 54 by the terminal plate 56 which bends in a direction away from the heating surface 36*a* (downward in FIG. 4) with respect to the heater unit 55 being screwed to the side plate 54*a* by the screw 81.

Further, as shown in FIG. 5, one recess 75*c* and two recesses 75*d* which are recessed toward the side opposite to the film heater 77 are formed on the support plate 75. On the bottom of the support plate 75, one temperature sensor 82 (thermistor) is attached at a position which corresponds to the recess 75*c* and two temperature detectors 83 (thermostats) for detecting excessive temperature rise are each attached at positions which correspond to the respective recesses 75*d*. The temperature sensor 82 has one insertion hole 82*a* and the recess 75*c* has a screw hole 75*e* on the bottom thereof at a position which corresponds to the insertion hole 82*a*. Further, each of the temperature detectors 83 have a pair of insertion holes 83*a* and each of the recesses 75*d* have a pair of screw holes 75*f* on the bottom thereof at positions which correspond to the insertion holes 83*a*.

As shown in FIG. 6, a raised portion 75*g* is formed on the bottom of the support plate 75 at a position which corresponds to the recess 75*c* (see FIG. 5). The temperature sensor 82 is fastened to the raised portion 75*g* with the top surface abutting against the raised portion 75*g* by the screw 84 screwed into the screw hole 75*e* (see FIG. 5) through the insertion hole 82*a* (see FIG. 5). Further, raised portions 75*h* are formed on the bottom of the support plate 75 at positions which correspond to the respective recesses 75*d* (see FIG. 5). Each of the temperature detectors 83 are fastened to the raised portions 75*h* with the top surface abutting against the raised portions 75*h* by the screws 85 screwed into the screw holes 75*f* (see FIG. 5) through the pair of insertion holes 83*a* (see FIG. 5).

The temperature sensor 82 shown in FIGS. 5 and 6, which is provided for temperature control, detects the temperature of the heater unit 55 (specifically, the support plate 75) and adjusts the temperature of the heating surface 36*a* to a set temperature. The temperature detectors 83, which are provided for abnormal temperature detection, detect the excessive temperature rise of the heating surface 36*a* and shut off the power to the heater 36 (that is, the film heater 77). The temperature sensor 82 and two temperature detectors 83 are each output temperature detection signals to a controller C (see FIG. 2) in the recording apparatus 11. Since the support plate 75 is made of aluminum having high heat conductivity, the support plate 75 can detect a heating temperature of the film heater 77 through the temperature sensor 82 without a significant delay. Each of the temperature detectors 83 are connected to the controller C via wires which extend from two terminals 83*b* of the respective temperature detectors 83 to terminals, which are not shown in the figure. In this example, two of three wires 57 connected to the terminal plate 56 of the film heater 77 are input lines and two types of heating temperature can be set by the two input lines. Two temperature detectors 83 each detect different excessive temperature rise which correspond to the two set temperature.

As shown in FIGS. 4 and 6, an upstream end of the heater 36 in the transportation direction Y is formed as an incline 36*b* which is inclined downward from the heating surface 36*a* to the upstream side in the transportation direction Y. In a configuration that the heater 36 is assembled to the recording apparatus 11, a leading edge of the paper sheet S fed out from the pair of transportation rollers 42 to the heater 36 is guided onto the heating surface 36*a* along the incline 36*b* even if the leading edge of the paper sheet S is curled downward.

As shown in FIG. 6, a distance d1 between the upstream roller 52 and the heating surface 36*a* and a distance d2 between the downstream roller 44 and the heating surface 36*a* are different. Specifically, the distance d1 between the upstream roller 52 and the heating surface 36*a* is larger than the distance d2 between the downstream roller 44 and the heating surface 36*a*. The distance d2 is equal to or slightly larger than a thickness of the paper sheet S. Accordingly, the downstream roller 44 presses the paper sheet S toward the heating surface 36*a* without collapsing the sponge of the roller member 61 so that the back surface of the paper sheet S abuts against the heating surface 36*a*. The distance d2 is configured such that, for example, if the sponge of the roller member 61 collapses to an unacceptable extent, the transportation resistance of the paper sheet S increases but does not exceed the acceptable value of the transportation resistance.

Further, the distance d1 is configured such that the leading edge of the paper sheet S can be guided to between the upstream roller 52 and the heating surface 36*a* if the leading edge of the paper sheet S is curled. That is, the distance d1 is configured such that the leading edge of the paper sheet S having a maximum curl within the expected range abuts against the peripheral surface of the roller members 59 at a position lower than the axis of the roller members 59 of the upstream roller 52. When the paper sheet S having a curl is transported onto the heater 36, the paper sheet S is brought close to the heating surface 36*a* by the upstream roller 52 so that heat from the heater 36 is effectively transferred to the paper sheet S. Further, the paper sheet S is slightly pressed by the upstream roller 52 so that a significant transportation resistance which compromises the positional accuracy in transportation (that is, the positional accuracy in printing in the transportation direction Y) of the paper sheet S is not applied to the paper sheet S. Further, the distance d1 is configured such that a load to the upstream roller 52 when the paper sheet S reaches the upstream roller 52 is reduced to such an extent that the positional accuracy in transportation is not deteriorated. For example, the distance d1 is set within a range between twice of the thickness of the paper sheet S and not more than 5 mm. The upstream roller 52 has a diameter larger than that of the downstream roller 44. Since the roller member 59 has a large diameter, the position of the axis of the roller members 59 relative to the heating surface 36*a* becomes high. This allows the leading edge of the paper sheet S having a curl to abut against the peripheral surface of the roller members 59 at a position lower than the axis of the roller members 59 without providing a large distance d1.

Further, since the roller member 61 made of sponge and the heating surface 36*a* nip the paper sheet S therebetween, the downstream roller 44 serves as a holder of the paper sheet S when the paper sheet S is cut by the cutter 37*a* of the cutter unit 37 which is disposed downstream of the downstream roller 44. In this example, the distance d2 between the roller member 61 and the heating surface 36*a* is smaller than the distance d1 and is set as a relatively small length which is equal to or slightly larger than the thickness of the paper sheet S. Accordingly, the distance d2 is sufficient to work as the holder for the paper sheet S when the paper sheet S is cut. Further, the roller width of the roller member 59 is larger than the roller width of a rubber roller member of a plurality of roller members that constitute the pair of transportation rollers 42 (for example, in the range of 1 to 2 mm), and is for example, in the range of 5 to 20 mm.

Next, operation of the recording apparatus 11 which is configured as described above will be described below. During operation of the recording apparatus 11, the paper sheet S is fed from the roll R and is transported by the pairs of transportation rollers 28 to 30 and the driving roller 43 and the like, and is then transported by the pairs of transportation rollers 40 to 42 to the transportation path on the top surface of the support member 51. Then, ink droplets are ejected by the liquid ejecting head 50 onto the surface of the paper sheet S which is supported on the support member 51, thereby printing the image or the like on the paper sheet S. During printing, the paper sheet S is transported downstream in the transportation direction Y while being nipped by the pairs of transportation rollers 41, 42. When the paper sheet S is guided onto the heating surface 36*a* of the heater 36, ink applied on the paper sheet S is dried by heat from the heating surface 36*a*. Since the paper sheet S passes close to the heating surface 36*a* while being pressed by the upstream roller 52 and the downstream roller 44, ink applied on the paper sheet S is efficiently dried.

Figure 7A:
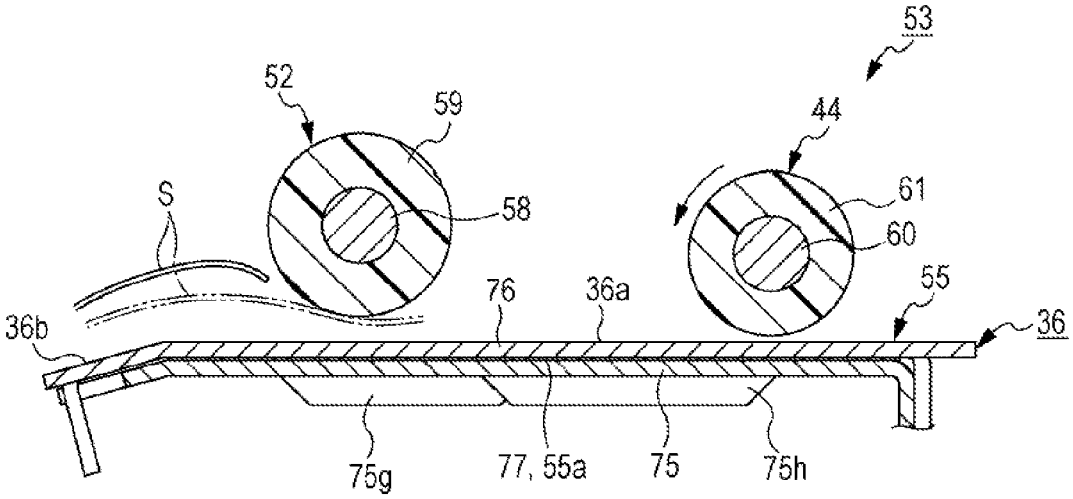
FIG. 7A is a schematic side view which shows that a leading edge of a paper sheet is being inserted between the heater and rollers.

As shown in FIG. 7A, even if the paper sheet S is curled downward as indicated by the solid line, the paper sheet S is guided into a gap between the upstream roller 52 and the heating surface 36*a* as indicated by the dashed-two dotted line with high certainty since the upstream roller 52 is spaced from the heating surface 36*a* by the distance d1 which is sufficiently larger than the thickness of the paper sheet S.

Figure 7B:
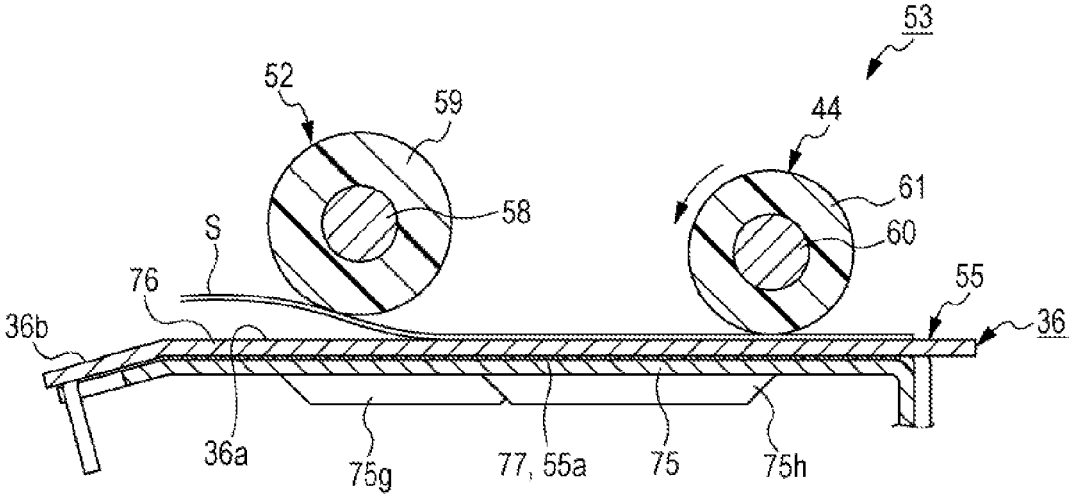
FIG. 7B is a schematic side view which shows that a paper sheet is transported between the heater and the rollers.

Then, as shown in FIG. 7B, a portion of the paper sheet S which has passed the gap between the upstream roller 52 and the heating surface 36*a* is pressed by the upstream roller 52 toward the heating surface 36*a* and is then pressed by the downstream roller 44 toward the heating surface 36*a*. The paper sheet S is pulled downstream by rotation of the downstream roller 44 while being pressed toward the heating surface 36*a*. As a result, the paper sheet S is transported between the upstream roller 52 and the downstream roller 44 while almost abutting against the heating surface 36*a*.

Further, since the roller members 59 of the upstream roller 52 are made of POM, which has a relatively high hardness, and are intermittently arranged in the axial direction (main scan direction X), the contact surface area with the paper sheet S is relatively small. Accordingly, ink applied on the printing surface of the paper sheet S is not likely to be transferred to the roller members 59. Further, the upstream roller 52 which is a driven roller is rotated when the paper sheet S abuts against the upstream roller 52. Moreover, the distance d1 between the upstream roller 52 and the heating surface 36*a* is provided as a length sufficiently larger than the thickness t of the paper sheet S (distance $d1 \geq d2 \geq t$). Accordingly, the paper sheet S tends to be prevented from abutting against the peripheral surface of the roller members 59 of the upstream roller 52 with a relatively large angle with respect to the tangential direction. As a result, the friction resistance applied to the paper sheet S when the paper sheet S abuts against the upstream roller 52 becomes relatively small. Therefore, rubbing on the printing surface of the paper sheet S by the upstream roller 52 can be reduced, thereby preventing the printing surface of the paper sheet S from being damaged. Moreover, the transportation resistance applied to the paper sheet S can be also reduced, thereby preventing decrease in the positional accuracy in transportation as much as possible.

If the upstream roller 52 becomes too close to the heating surface 36*a* (for example, distance d1≤d2), the paper sheet S abuts against the peripheral surface of the roller members 59 with an angle at a position closer to the axis of the roller members 59 than to the lower end of the roller members 59 (on the side of the heating surface 36*a*). This leads to a large transportation resistance applied to the paper sheet S by the upstream roller 52, which causes the positional accuracy in transportation of the paper sheet S to decrease. In this embodiment, however, since the distance d1 between the upstream roller 52 and the heating surface 36*a* is relatively large (distance d1>d2), and a plurality of roller members 59 each having a relatively small roller width are intermittently arranged in the axial direction, the transportation resistance applied to the paper sheet S by the upstream roller 52 becomes relatively small. Accordingly, the positional accuracy in transportation necessary to the paper sheet S can be achieved. Therefore, it is possible to prevent decrease in the positional accuracy in printing such as displacement of printing position on the paper sheet S in the transportation direction Y due to decrease in the positional accuracy in transportation of the paper sheet S so that the liquid ejecting head 50 performs printing of the paper sheet S with relatively high positional accuracy.

The downstream roller 44 provided at a position on the downstream side of the heating surface 36*a* presses a portion of the paper sheet S which has been dried to a certain extent by heat transferred from the heating surface 36*a*. Further, the downstream roller 44 also transmits the transportation force via the contact surface (printing surface) of the paper sheet S so as to transport the paper sheet S. Accordingly, the friction resistance is necessary between the roller member 61 of the downstream roller 44 and the surface of the paper sheet S so as to transmit the transportation force to the paper sheet S. In this example, since the roller member 61 of the downstream roller 44 is a single roller in a cylindrical shape elongated in the axial direction, the roller member 61 comes into contact with the paper sheet S in the entire area in the width direction of the paper sheet S, thereby ensuring a large contact surface area between the roller member 61 and the paper sheet S. Accordingly, the friction resistance which is necessary to transmit the transportation force between the roller member 61 and the paper sheet S can be achieved. Therefore, the necessary transportation force is transmitted from the downstream roller 44 to the paper sheet S, and the paper sheet S can be transported downstream in the transportation direction Y with high certainty.

If the roller member of the downstream roller 44 is made of a non-porous resin (for example, POM), such roller has a small friction resistance to the surface (printing surface) of the paper sheet S compared with the roller made of a porous sponge. This leads to a failure in transmitting the necessary transportation force to the paper sheet S and a risk of slippage between the downstream roller 44 and the paper sheet S. In order to prevent such slippage, for example, it is necessary to provide the distance d2 between the upstream roller 52 and the heating surface 36*a* of the heater 36 as being smaller than the thickness t of the paper sheet S and increase the friction resistance by strongly pressing the paper sheet S by using the roller member. In this case, if the paper sheet S is pressed against the heating surface 36*a* with a strong force, the friction resistance between the back surface (opposite to the printing surface) of the paper sheet S and the heating surface 36*a* increases, and transportation ability of the paper sheet S by the downstream roller 44 tends to largely vary depending on the variation in friction resistance between the back surface of the paper sheet S and the heating surface 36*a*. This leads to a problem in that variation in transportation ability frequently occurs. In this embodiment, in order to decrease the friction resistance between the back surface of the paper sheet S and the heating surface 36*a*, the distance d2 is provided as a length that allows the downstream roller 44 not to press the paper sheet S against the heating surface 36*a*. For example, when t is the thickness of the paper sheet S, the distance d2 is provided as a value equal to or larger than the thickness t of the paper sheet S (t<d2<d1). For example, the distance d2 satisfies the expression: t≤d2≤2t<d1. As a matter of course, such distance d2 is merely an example, and the distance d2 other than the above range can be provided.

Further, if the roller member 61 of the downstream roller 44 is made of sponge, dimensional tolerance of the roller member 61 needs to be large compared with that of a non-porous resin roller. For example, if the distance d2 of such roller is provided with the same tolerance as that of the resin roller, when the distance d2 varies in a smaller range, the range of distance d2 of the sponge roller becomes smaller than that of the resin roller. As a consequence, the friction resistance between the roller member 61 and the paper sheet S increases. Accordingly, in the case where a sponge roller is used as the roller member 61, the dimensional tolerance of the roller member 61 is provided as being larger than that of a resin roller, and the distance d2 is provided as being larger than the thickness t of the paper sheet S (2t≤d2>t), for example. As a matter of course, such distance d2 is merely an example, and the distance d2 other than the above range can be provided.

Although the roller member 61 of the downstream roller 44 also may be a rubber roller, a rubber generally has a friction resistance larger than a sponge and adjustment to achieve the necessary friction resistance is relatively cumbersome. Accordingly, in this example, a sponge roller is used as the roller member 61 of the downstream roller 44. However, a rubber roller can also be used although adjustment of friction resistance is difficult to some extent, and a non-porous resin roller can be used if the friction resistance which is small to some extent is allowable for the material of the medium.

Since the downstream roller 44 is a single roller member 61 formed in a cylindrical shape elongated in the axial direction, the downstream roller 44 can press the paper sheet S so that the entire area in the width direction of the paper sheet S almost comes into contact with the heating surface 36*a*. In this configuration, the distance d2 between the roller member 61 of the downstream roller 44 and the heating surface 36*a* is almost equal to the thickness t of the paper sheet S (for example, 2t>d2>t). As a consequence, the paper sheet S can almost abut against the heating surface 36*a* without collapsing the sponge of the roller member 61.

Further, even if the distance d2 varies and becomes smaller than the thickness t of the paper sheet S, the roller member 61 has a cushioning property and a portion of the roller member 61 which abuts against the paper sheet S deforms. Accordingly, the friction resistance between the paper sheet S and the heating surface 36*a* can be relatively decreased compared with the case using a resin roller made of a hard material (non-porous material). As a result, even if the distance d2 varies, a relatively appropriate transportation resistance can be applied between the downstream roller 44 and the paper sheet S, thereby smoothly transporting the paper sheet S downstream in the transportation direction Y.

Once the paper sheet S fed out from the heater 36 is transported downstream in the transportation direction Y, the paper sheet S stops and is cut by the cutter 37*a* of the cutter unit 37 every time when the paper sheet S reaches the specific transportation position of the specific unit length. During this operation, the paper sheet S is cut by the cutter 37*a* moving in the main scan direction X while the downstream roller 44 presses the paper sheet S at a position slightly upstream in the transportation direction Y with respect to the cutting path of the cutter 37*a*. Accordingly, the paper sheet S can be cut in an almost straight line in the main scan direction X.

According to the above embodiment, the following effect can be achieved:

(1) The heater 36 having the heating surface 36*a* which also serves as the transportation surface of the paper sheet S, the upstream roller 52 disposed at a position opposite the heating surface 36*a* with respect to the transportation path of the paper sheet S, and the downstream roller 44 that is disposed at a position downstream to the upstream roller 52 in the transportation direction Y and opposite the heating surface 36*a* with respect to the transportation path are disposed downstream to the liquid ejecting head 50 in the transportation direction Y. Further, the distance d1 between the upstream roller 52 and the heating surface 36*a* and the distance d2 between the downstream roller 44 and the heating surface 36*a* are different. As a result, even if the paper sheet S is curled, it is possible to hold the paper sheet S toward the heating surface 36*a* by the downstream roller 44 which has the smaller distance from the heating surface 36*a* while holding the paper sheet S toward the heating surface 36*a* by the upstream roller 52 which has the larger distance from the heating surface 36*a*. Since the paper sheet S passes close to the heating surface 36*a*, ink applied on the paper sheet S can be efficiently dried even if the paper sheet S is curled.

(2) The distance d1 between the upstream roller 52 and the heating surface 36*a* is larger than the distance d2 between the downstream roller 44 and the heating surface 36*a*. Accordingly, the curled leading edge of the paper sheet S can be guided into the gap between the upstream roller 52 and the heating surface 36*a* with certainty, and then the paper sheet S can be brought further close to the heating surface 36*a* by the downstream roller 44. For example, it is possible to improve the dry efficiency by the paper sheet S abutting against the heating surface 36*a* as sufficiently as possible by the upstream roller 52 and the downstream roller 44.

(3) The upstream roller 52 is a driven roller that is rotated when the transported paper sheet S abuts against the upstream roller 52, and the downstream roller 44 is a driving roller that transports the paper sheet S while pressing the paper sheet S. Accordingly, even if the upstream roller 52 is a driven roller that is rotated while pressing the paper sheet S, the friction resistance between the upstream roller 52 and the paper sheet S when pressing the paper sheet S can be relatively small, since the distance d1 from the heating surface 36*a* to the upstream roller 52 is larger than the distance d2 from the heating surface 36*a* to the downstream roller 44 (≥t). For example, the transportation resistance applied from the roller 44, 52 to the paper sheet S can be relatively small, thereby preventing a decrease in positional accuracy in transportation of the paper sheet S as much as possible.

(4) Since the roller member 59 of the upstream roller 52 and the roller member 61 of the downstream roller 44 are made of different material, the friction resistance between the roller member 59 and the paper sheet S and the friction resistance between the roller member 61 and the paper sheet S may be different. For example, if the friction resistance between the roller member 59 and the paper sheet S and the friction resistance between the roller member 61 and the paper sheet S are both large, a large transportation resistance is applied to the paper sheet S, thereby leading to a decrease in the positional accuracy in transportation of the paper sheet S. As a result, for example, there is a risk that the positional accuracy of ink ejected onto the paper sheet S may be decreased. However, since the friction resistance between the roller member 59 and the paper sheet S and the friction resistance between the roller member 61 and the paper sheet S are different, the transportation resistance applied to the paper sheet S from the roller member 59 which has the smaller friction resistance to the paper sheet S can be decreased relatively small. Further, the downstream roller 44 may be composed of a driving roller so that an appropriate friction resistance depending on the material of the roller member 61 is applied to the paper sheet S, thereby transmitting the rotation force of the roller member 61 as the transportation force of the paper sheet S with certainty.

(5) The roller member 59 of the upstream roller 52 is made of a material harder than that of the roller member 61 of the downstream roller 44, and a plurality of the roller members 59 are provided spaced apart from each other in an axial direction of the support shaft 58. Accordingly, the contact surface area between the roller members 59 of the upstream roller 52 and the printing surface (the surface on which ink is applied) of the paper sheet S which is not yet dried can be decreased relatively small so as to reduce ink transfer from the paper sheet S to the roller members 59, and the transportation resistance of the paper sheet S due to contact between the paper sheet S and the roller members 59 can be decreased relatively small. Further, since the roller member 61 of the downstream roller 44 is made of a material softer than that of the roller members 59 of the upstream roller 52, a cushioning property of the soft material allows the transportation resistance applied to the paper sheet S to be decreased relatively small for the pressing force.

(6) Since the roller member 61 of the downstream roller 44 is made of sponge, the roller member 61 tends to deform due to its cushioning property even if the paper sheet S is pressed against the heating surface 36*a* of the heater 36 by the roller member 61. Accordingly, the transportation resistance to the paper sheet S can be decreased relatively small. Since the roller member 61 of the downstream roller 44 which is a driving roller is made of sponge, an appropriate friction resistance is applied between the paper sheet S and the roller member 61 so that the paper sheet S can be reliably transported by the roller member 61 without causing slippage.

(7) Since the roller member 61 of the downstream roller 44 has a length in the axial direction sufficient to press the entire area in the width direction of the paper sheet S, the paper sheet S can be pressed by the roller members 59 across the wide area in the axial direction. Accordingly, the paper sheet S can abut against the heating surface 36*a* in a wider area in the width direction, thereby ensuring a large abutting surface area (contact surface area) between the paper sheet S and the heating surface 36*a* and facilitating drying of the paper sheet S.

(8) Since the transportation resistance applied to the paper sheet S from the upstream roller 52 and the downstream roller 44 is relatively small, it is possible to prevent a decrease in positional accuracy in transportation of the paper sheet S due to the transportation resistance when the paper sheet S is transported by the pairs of transportation rollers 40 to 42 which are disposed upstream to the heater 36 in the transportation direction Y.

The invention is not limited to the foregoing embodiment and can be modified as follows.

The heating surface (transportation surface) is not limited to a flat surface and may be, for example, a convex curved surface or a concave curved surface.

At least one of the upstream roller 52 and the downstream roller 44 may be movable in a direction that allows the distance from the heating surface to be varied. In this case, the distance may be manually adjusted, or alternatively, the distance from the upstream roller 52 to the heating surface and from the downstream roller 44 to the heating surface can be adjusted depending on the thickness of the paper sheet (thickness of the medium) which varies depending on the type of the paper sheet to be input as one of the print conditions according to the drive source such as an electric motor and a cylinder. The distance is preferably satisfies the condition: d1>d2.

The roller member 61 of the downstream roller 44 may have a diameter smaller than that of the roller member 59 of the upstream roller 52, or alternatively, both the roller members 59, 61 may have an almost equal diameter.

The upstream roller 52 and the downstream roller 44 may be made of the same material. For example, both the roller members 59, 61 may be made of POM, or alternatively, may be made of sponge.

In the case where the upstream roller 52 and the downstream roller 44 are made of different materials, the roller member 59 of the upstream roller 52 may be made of sponge and the roller member 61 of the downstream roller 44 may be made of POM. Different materials of the roller members 59, 61 can be combined as appropriate.

The configuration of the heater is not limited to that has the plates on each side of the film heater. Any heater which includes a guide plate that serves as both the transportation surface and the heating surface and a heat source that supplies heat to the guide plate may be used. The heat source may include, in addition to the heating element, a hot air generator that generates a hot air and blows the hot air to the guide plate and a hot water type heat source that supplies hot water or the like into the tube (flow path) provided in the guide plate or on the bottom surface of the guide plate. The heating element is not limited to that is configured to transfer heat by direct contact with the guide plate but also includes that is configured to heat the guide plate from a position away from the guide plate by heat radiation.

Both the upstream roller 52 and the downstream roller 44 may be a driven roller. Alternatively, both the upstream roller 52 and the downstream roller 44 may be a driving roller. In such a configuration, as long as the distance d1>d2 is satisfied, the curled medium can be pressed toward the heating surface 36*a* while being guided into the gap between the upstream roller 52 and the heating surface 36*a* with certainty, and then the medium can be brought further close to the heating surface by the downstream roller 44.

In the case where the upstream roller 52 or the downstream roller 44 is a driven roller, one roller member or a plurality of roller members may be provided on the support shaft and configured to be rotatable integrally with the shaft or relatively to the shaft.

The medium may be a cut paper instead of a roll paper. Although the cut paper tends to curl with the printing surface curved inward, such a curled paper sheet can be pressed toward the heating surface 36*a*.

The heater is not limited to a plate-shaped heater such as the film heater 77, but also includes that has a heater line arranged in a specific path or a plurality of heater lines arranged parallel to each other. Further, at least one of the heating plate and the support plate may be made of an iron metal, a copper metal and other metal material. Further, the heater may include the heating plate and the heating element only and does not include the support plate.

A pair of transportation rollers may be further provided downstream to the downstream roller 44 in the transportation direction Y.

The medium holding roller for holding the medium toward the heating surface of the heater is not limited to two rollers of the upstream roller 52 and the downstream roller 44, but may be three or more rollers including these two rollers. For example, an intermediate roller may be disposed between the upstream roller 52 and the downstream roller 44 in the transportation direction Y. In this configuration, a distance d3 between the intermediate roller and the heating surface 36*a* is preferably d1≥d3≥d2. Further, the medium holding roller may be disposed upstream to the upstream roller 52 in the transportation direction Y or downstream to the downstream roller 44 in the transportation direction Y. In this configuration, a distance d4 between the medium holding roller disposed upstream to the upstream roller 52 and the heating surface may be d4≥d1, and a distance d5 between the medium holding roller disposed downstream to the downstream roller 44 and the heating surface may be d5≤d2.

In the above embodiments, the medium is not limited to a paper sheet, and other materials such as a cloth, resin film, resin sheet and metal sheet may also be used.

The liquid ejecting apparatus is not limited to the recording apparatus 11 that ejects ink as described in the above embodiments, but also may be a liquid ejecting apparatus that ejects liquid other than ink. The liquid ejected from the liquid ejecting apparatus includes the liquid in the form of fine liquid droplets including the droplets in a particle, tear drop or string shape. The liquid as described herein may be any material that can be ejected from liquid ejecting apparatus. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Typical examples of liquid include ink as mentioned above, liquid crystal and the like. The ink as described herein includes various liquid components such as general water-based ink, oil-based ink, gel ink and hot melt ink. Specific examples of liquid ejecting apparatus may include, for example, liquid ejecting apparatuses that eject liquid containing materials such as electrode material and color material in a dispersed or dissolved state, which are used for manufacturing of liquid crystal displays, electro-luminescence (EL) displays, surface emitting displays or color filters. Further, the examples of liquid ejecting apparatus may include liquid ejecting apparatuses that eject bioorganic materials used for manufacturing biochips, liquid ejection apparatuses that are used as a precision pipette and eject liquid of a sample, textile printing apparatuses and micro dispensers. The examples of liquid ejecting apparatus may also include liquid ejecting apparatuses that eject lubricant to precision instrument such as a clock or camera in a pin-point manner, liquid ejecting apparatuses that eject transparent resin liquid such as ultraviolet cured resin onto a substrate for manufacturing minute hemispheric lenses (optical lenses) used for optical communication elements or the like, and liquid ejecting apparatuses that eject acid or alkali etching liquid for etching a substrate or the like.

Technical ideas which come from the foregoing embodiments and modified examples will be described below.

(a) The distance between the downstream roller 44 and the heating surface 36*a* is a distance that allows the medium pressed by the downstream roller 44 to abut against the heating surface 36*a*. With this configuration, a dry efficiency can be improved by abutting the medium against the heating surface 36*a* by the downstream roller 44.

(b) The distance between the upstream roller 52 and the heating surface 36*a* is larger than the thickness of the medium. With this configuration, each of the friction resistance between the upstream roller 52 and the medium and the friction resistance between the medium and the heating surface 36*a* can be decreased. For example, a decrease in the positional accuracy in transportation of the medium can be decreased.

(c) The cutter 37*a* that cuts the medium is disposed downstream to the downstream roller 44 in the transportation direction. With this configuration, since the distance between the downstream roller 44 and the heating surface 36*a* is relatively small, the cutter 37*a* can be used while the medium is pressed by the downstream roller 44 at a position upstream to the cutter 37*a*. Accordingly, the medium can be cut relatively clearly by the cutter 37*a*.

The entire disclosure of Japanese Patent Application No. 2012-219443, filed Oct. 1, 2012 is expressly incorporated by reference herein.

What is claimed is:

1. A liquid ejecting apparatus including a liquid ejecting head that ejects liquid onto a medium, comprising:

a heater having a heating surface which also serves as a transportation surface of the medium, the heater being disposed downstream to the liquid ejecting head in a transportation direction of the medium;

a rotatable upstream roller that is disposed at a position opposite the heating surface with respect to a transportation path of the medium;

a rotatable downstream roller that is disposed at a position downstream to the upstream roller in the transportation direction and opposite the heating surface with respect to the transportation path of the medium, wherein a distance between the upstream roller and the heating surface and a distance between the downstream roller and the heating surface are different; and a pair of transportation rollers that transports the medium is disposed between the liquid ejecting head and the upstream roller in the transportation direction, rotation of the pair of transportation rollers driving rotation of a shaft supporting the rotatable downstream roller and movement of the medium driving rotation of the rotatable upstream roller.

2. The liquid ejecting apparatus according to claim 1, wherein the distance between the upstream roller and the heating surface is larger than a distance between the downstream roller and the heating surface.

3. The liquid ejecting apparatus according to claim 2, wherein the upstream roller is a driven roller that is rotated when the transported medium abuts against the upstream roller, and the downstream roller is a driving roller that transports the medium while pressing the medium.

4. The liquid ejecting apparatus according to claim 1, wherein the upstream roller and the downstream roller include a shaft and a roller member that is rotatable integrally with the shaft or relatively to the shaft, and the roller member of the upstream roller and the roller member of the downstream roller are made of different materials.

5. The liquid ejecting apparatus according to claim 4, wherein the roller member of the upstream roller is made of a material harder than that of the roller member of the downstream roller, and a plurality of the roller members of the upstream roller are provided spaced apart from each other in an axial direction.

6. The liquid ejecting apparatus according to claim 4, wherein the roller member of the downstream roller is made of sponge.

7. The liquid ejecting apparatus according to claim 4, wherein the roller member of the downstream roller has a length in an axial direction that covers the entire area in a width direction of the medium.

* * * * *